United States Patent [19]

Polcz et al.

[11] Patent Number: 5,011,442

[45] Date of Patent: Apr. 30, 1991

[54] AUXILIARY POWER GENERATION MEANS FOR OUTBOARD MOTORS

[76] Inventors: Laszlo Polcz, 878 Cabot Trail, Milton, Ontario, Canada, L9T 3W3; Salvatore Sgro, 85 Clement Road, Etobicoke, Ontario, Canada, M9R 1Z1

[21] Appl. No.: 435,054

[22] Filed: Nov. 13, 1989

[51] Int. Cl.[5] ..... B63H 21/26

[52] U.S. Cl. ..... 440/900; 290/1 R; 123/195 E

[58] Field of Search ..... 440/3, 6, 7, 49, 113, 440/900, 89; 290/1 R, 1 A, 1 B, 1 C, 1 D, 1 E, 43, 50, 54; 310/58, 59; 123/195 E, 195 P; 74/15.63, 15.6

[56] References Cited

U.S. PATENT DOCUMENTS

| | | | |
|---|---|---|---|
| 2,256,831 | 9/1941 | Karey | 440/89 |
| 2,603,202 | 7/1952 | Kiekhaefer | 123/195 E |
| 3,230,698 | 1/1966 | Nettles | 440/3 |
| 4,010,377 | 3/1977 | McKenzie | 290/1 R |
| 4,695,261 | 9/1987 | Broughton et al. | 440/900 |
| 4,779,905 | 10/1988 | Ito et al. | 290/1 A |

*Primary Examiner*—Joseph F. Peters, Jr.
*Assistant Examiner*—Jesus D. Sotelo

[57] ABSTRACT

An auxiliary power generation device is provided for use in outboard motors having a typically horizontal flywheel with a recoil starter mounted thereabove. The device includes an alternator adapted for installation between the flywheel and the recoil starter. The alternator has a rotor shaft projecting from both ends of the alternator, and is intended for mounting coaxially with the flywheel and the recoil starter. Rollers project upwardly from the upper surface of the flywheel for engaging rollers suspended from the lower end of the rotor shaft of the alternator. Rotation of the flywheel thus produces rotation of the alternator rotor shaft, and vice verse. The recoil starter is connected to the upper end of the rotor shaft.

1 Claim, 6 Drawing Sheets

AUXILIARY POWER GENERATION MEANS FOR OUTBOARD MOTORS

BACKGROUND OF THE INVENTION

This invention relates to auxiliary power generation means, and particularly to a dedicated marine power generator intended primarily for use on small vessels, and particularly adapted for installation on and use with outboard motors.

There is a need for an innovative alternative source to condition-dependent power generation devices such as wind generators, portable gasoline generators, and solar panels which all serve to augment the charging coils.

SUMMARY OF THE INVENTION

It is an object of the invention to provide a readily available and affordable device for auxiliary power generation.

Thus in accordance with the present invention an auxiliary power generation device is provided for use in outboard motors having a typically horizontal flywheel, for example, with a recoil starter mounted thereabove. The device includes an alternator adapted for installation between the flywheel and the recoil starter. The alternator has a rotor shaft projecting from both ends of the alternator, and is intended for mounting coaxially with the flywheel and the recoil starter. Means are mounted on the upper surface of the flywheel for engaging means mounted on the lower end of the rotor shaft of the alternator. Rotation of the flywheel thus produces rotation of the alternator rotor shaft, and vice versa. Means are provided for connecting the recoil starter with the upper end of the rotor shaft.

In contrast to the previous alternatives, the invention is not condition-dependent (e.g., whether or not it is a cloudy day, whether or not the wind is calm, etc.), and is intended to supply reliable, immediate and plentiful electrical power on demand, satisfying electrical draw of convenience items and safety equipment on pleasure and commercial craft (powered by means of outboard motors). The invention is weight and space efficient, and is safe from fumes inside the vessel by virtue of being located within the outboard powerhead outside of the vessel itself. The invention is a practical solution for small sailing craft or other vessels.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
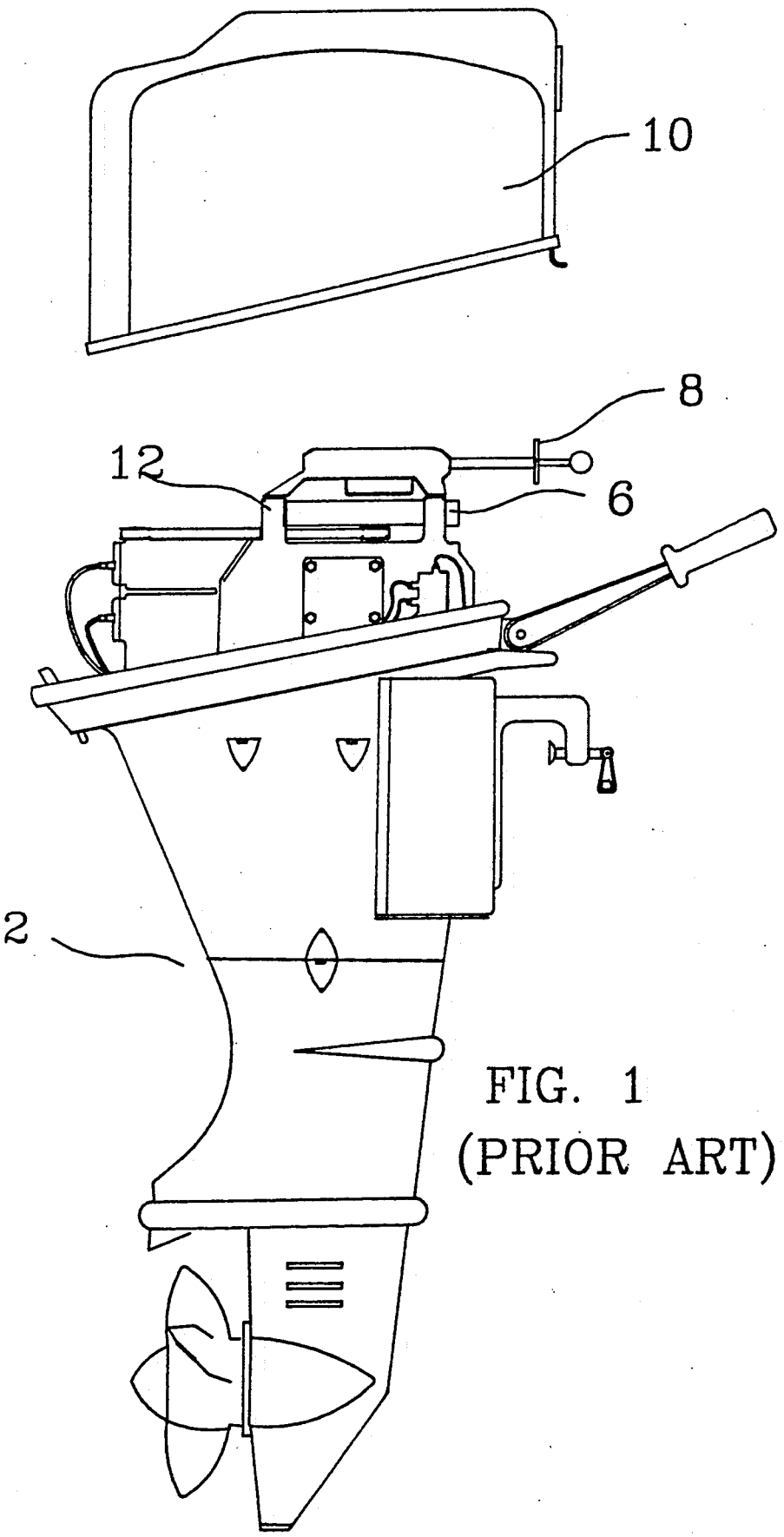
FIG. 1 (PRIOR ART)
FIG. 1 is a side view of an outboard motor without the invention installed.

Referring now to the drawings, the preferred embodiment of the invention consists of an electrical current generating device or capable of producing peak power of typically 1000 watts, or more or less, when directly coupled to a mechanical source of greater value, specifically and namely the power unit of a marine outboard motor 2, or derivatives and adaptations of the same. The novelty, uniqueness, utility and the significant difference of this invention from other devices intended to provide auxiliary electrical current for and/or in addition to feeding current to the coil, is its notably greater current output capability and the achievement of this increase through the application of a voltage regulated and rectified alternating current generator rated at typically 1000 watts or greater, as opposed to magnetic coil or charging coil systems typically rated at 120 watts at peak R.P.M. as presently employed. This device is positioned within the powerhead, and is best described as an alternator 4 permanently coupled in between existing components, namely above the flywheel 6 and below the repositioned recoil starter 8, if so equipped.

The device functions primarily as an efficient and quick replenisher of storage batteries, while offshore and/or under conditions not favourable for reliance on other means. It is also capable of providing electrical current in the event of battery insufficiency. With the available inverter it can enable the user to employ A.C. power consuming appliances in addition to the standard D.C. supply. Thus boaters gain access, through use of the invention, to power to operate a much greater range of tools and appliances.

FIG. 1 shows a typical outboard motor 2, for example a Honda (trademark) 7.5 HP motor. Included is a cowl 10, recoil starter 8, mounting bracket 12, and flywheel 6.

Figure 2:
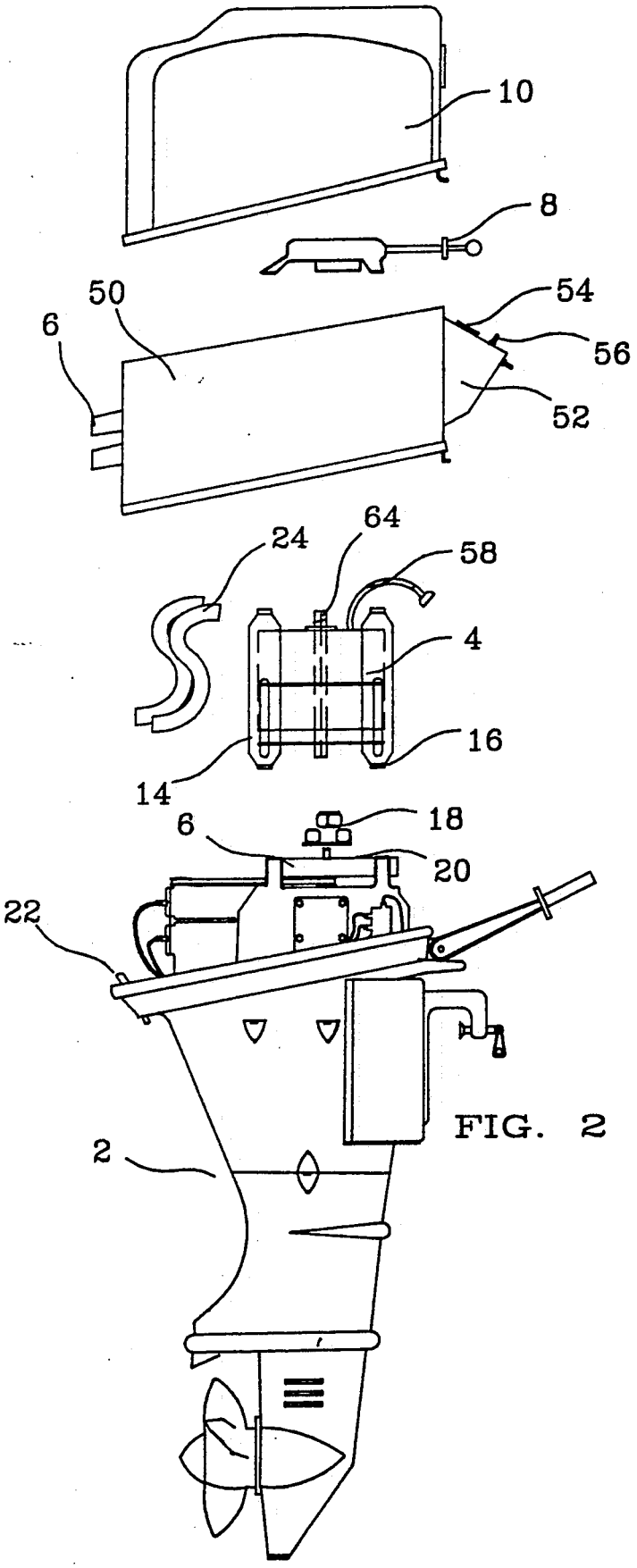
FIG. 2 is a side view similar to FIG. 1, but with the key parts exploded.
Figure 3:
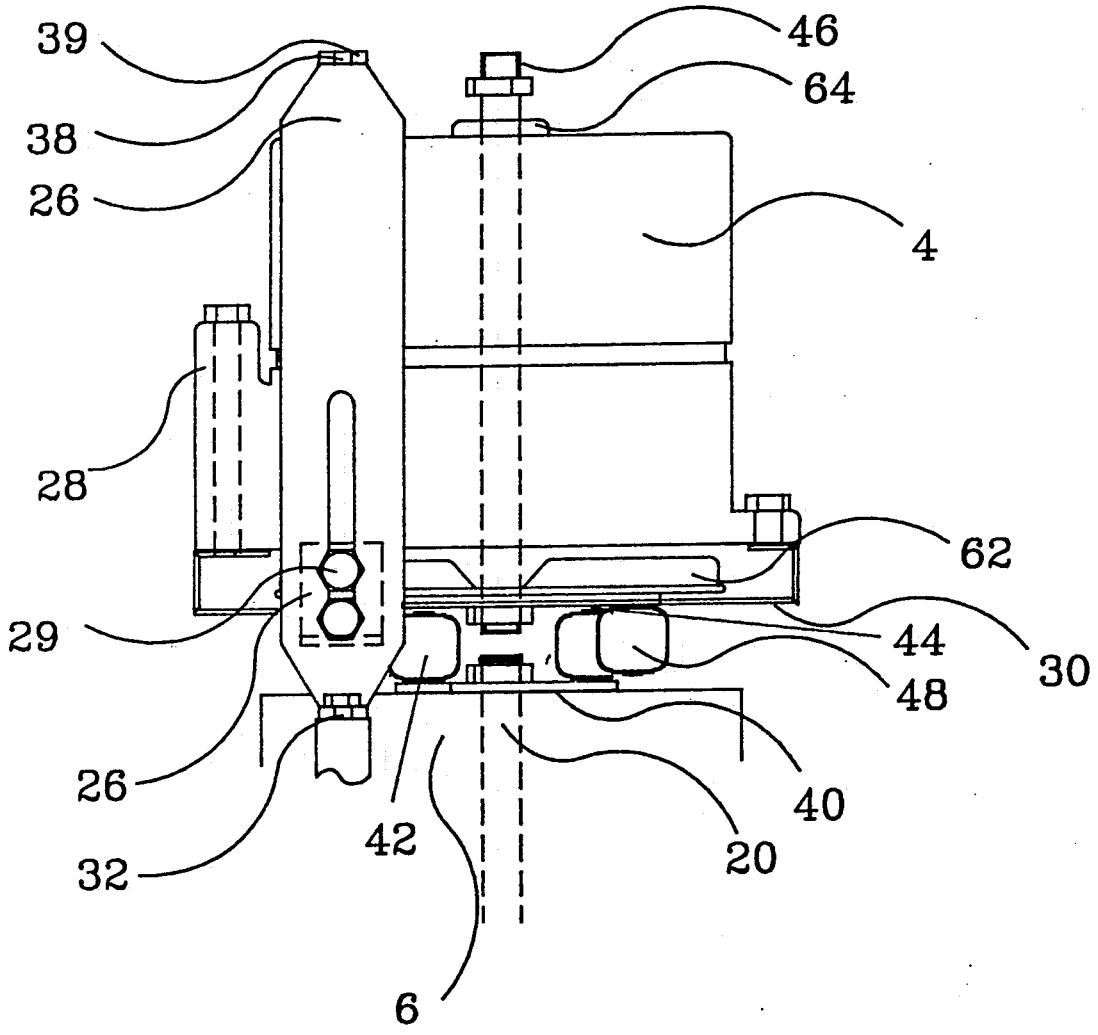
FIG. 3 is a side view of the alternator.
Figure 4:
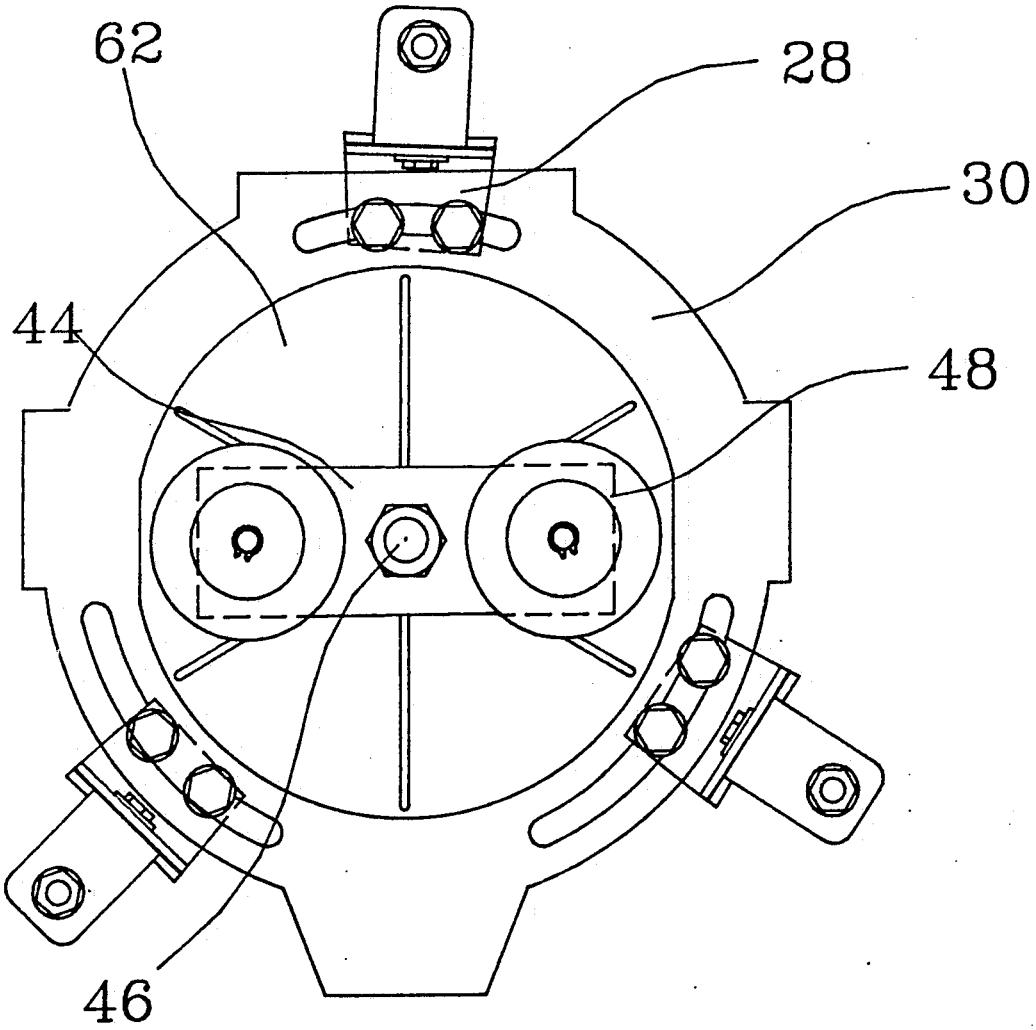
FIG. 4 is a bottom view of the alternator.

In FIG. 2, the invention is added to the conventional motor of FIG. 1. The alternator 4 has air cooling intake/exhaust ports 14. Cushion mounts 16 may be provided. (The alternator assembly, preferably mounted on legs 26 as described below rather than directly as illustrated in FIG. 2, may or may not be dampened or cushioned on its mounts, depending on the application.) There is a connecting joint assembly 18 with tolerance and cushion compensation, either of the "love joint" type illustrated in FIG. 2, or preferably as illustrated in FIGS. 3 and 4 and described below. FIG. 2 also shows the threaded crankshaft end 20, a lock 22, mounting bracket 12, and flexible air ducts 24 (not required in some cases).

The embodiment shown in FIG. 2 is essentially universal. It may be advantageous in some cases to produce embodiments which are dedicated to particular motors, if volumes warrant.

Referring now to FIGS. 3 and 4, the alternator 4 is mounted above the flywheel 6. It is mounted on three articulating legs 26 spaced apart from each other, by virtue of three slider attachments 28 attached by positioning screws 29 or perimeter clamps or the like, to a grooved slider rim 30 and lower alternator housing plate. The bottom portion of each leg has a flange 32 with a bolt hole 33 so that the leg can be mounted on the recoil starter mounting holes 34 in the mounting bracket 16. The legs are permitted to articulate as long as the bolts 36 are loosened, so that the alternator can be properly positioned on a variety of motors, thus providing at least a degree of universality. The top of each leg is provided with an upper flange 38 with a threaded mounting hole 39 for receiving the mounting bolt from the recoil starter.

Mounted on top of the flywheel, supported above a mounting plate 40 attached to the flywheel, are two rollers 42 mounted on vertical axes. Mounted under the alternator, suspended from a mounting plate 44 connected to the alternator rotor shaft 46, are two corresponding rollers 48, seen also in FIG. 4. When the flywheel is rotating, the flywheel-mounted rollers 42 rotate into contact with the alternator-mounted rollers 48, thus driving the alternator.

The recoil starter 8 is connected to the top of the alternator rotor shaft 46, so during starting, the alternator-mounted rollers 48 drive the flywheel-mounted rollers 42 to produce rotation of the engine crankshaft, to start the motor.

Referring again to FIG. 2, to provide space to accommodate the alternator, a spacer assembly 50 is used. Mounted on the front panel 52 of the spacer assembly is an ammeter 54 or other charge monitoring device, and output electrical connections 56. A plug 58 transmits the alternator output to the panel. The spacer may include air cooling intake/exhaust ports 6 to which the flexible ducts 24 from the ports 14 connect. AlternativelY, the spacer may be provided with suitable ventilation apertures, to allow ventilation of the air-cooled alternator.

The alternator 4 is a conventional alternator with built-in regulator, such as the Delco (trademark) 100 A alternator, modified in several respects:

1. Instead of a unidirectional fan with angled or curved blades, a high efficiency bi-directional fan 62, i.e. one with vertical blades, is used, since the direction of rotation is different from the usual one.

2. The top bearing 64 is open instead of capped, since the alternator rotor shaft 46 must project through the alternator.

3. The rectifier assembly 66 is upgraded to higher amperage (e.g. from 25 to 50 A diodes).

Figure 5:
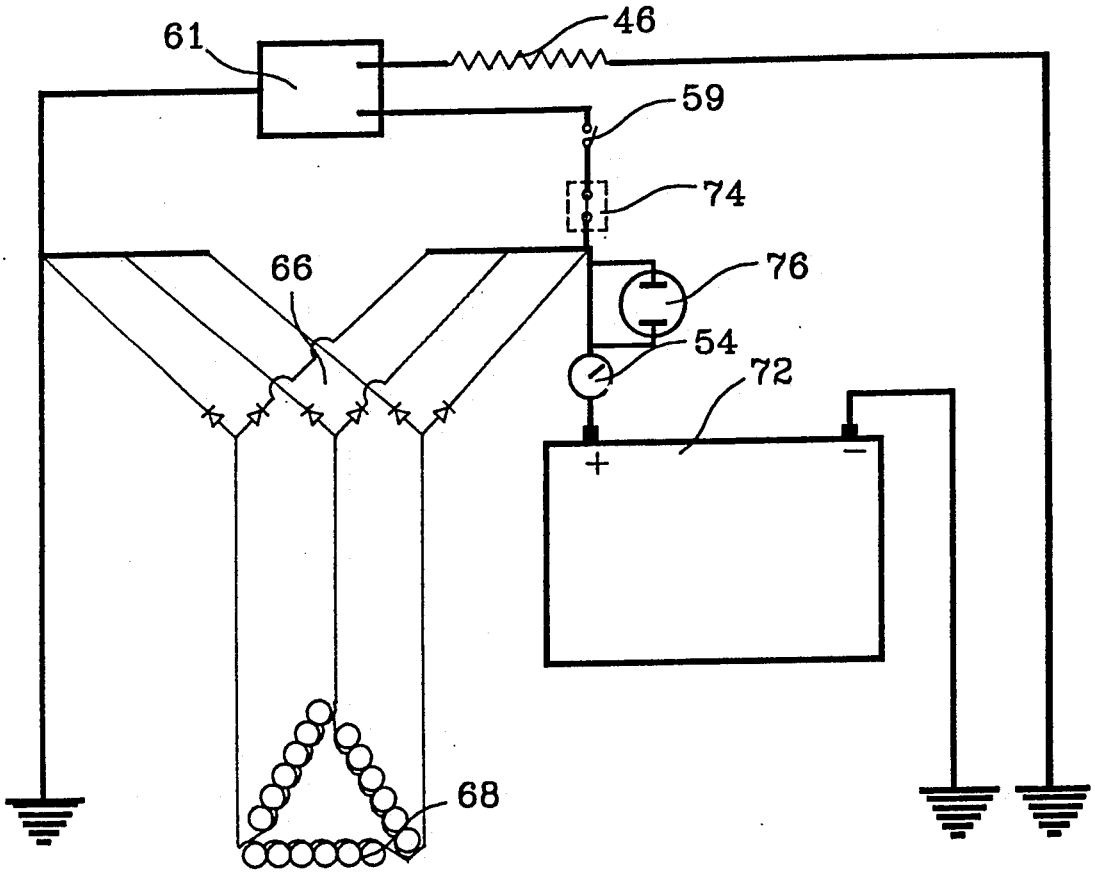
FIG. 5 is circuit diagram.

4. The stator 68 is delta wound, as seen in the circuit diagram (FIG. 5).

5. A low voltage, low-cut in regulator 61 is used, with an internal heat transfer gel for better cooling.

The steps in installing the alternator are essentially as follows:

1. Remove outboard cover 10
2. Remove spark plugs for safety. Replace when finished
3. Remove recoil starter 8
4. Remove attachment for recoil starter from flywheel 6
5. Disconnect throttle limiting lever in Neutral—to run the alternator at the desired R.P.M. for desired current output. (E.g. 1200 RPM=48 Amps; 3750 RPM - 100 Amps)
6. Bolt the lower roller mounting plate 40 onto the flywheel
7. Align alternator support legs 26 to fit on recoil starter original mountings, using 3 bolts
8. Bolt on alternator
9. Replace lower recoil starter mounting on to alternator rotor shaft
10. Re-bolt recoil starter to upper leg protrusions
11. Install lower spacer cover—instrument panel 52 facing forward
12. Connect harness from alternator to spacer cover via plug 58
13. Replace outboard cover 10
14. Make the electrical connections from the front panel 52 to battery switch or direct to battery
15. Turn switch -on- on panel
16. Start engine FIG. 5 shows the electrical diagram of the preferred embodiment. The main components are the rotor 46, switch 59, voltage regulator 61, stator 68, ammeter 54 or other charge monitor, rectifier assembly 66, battery 72, fuse 74, and light 76.

Figure 6:
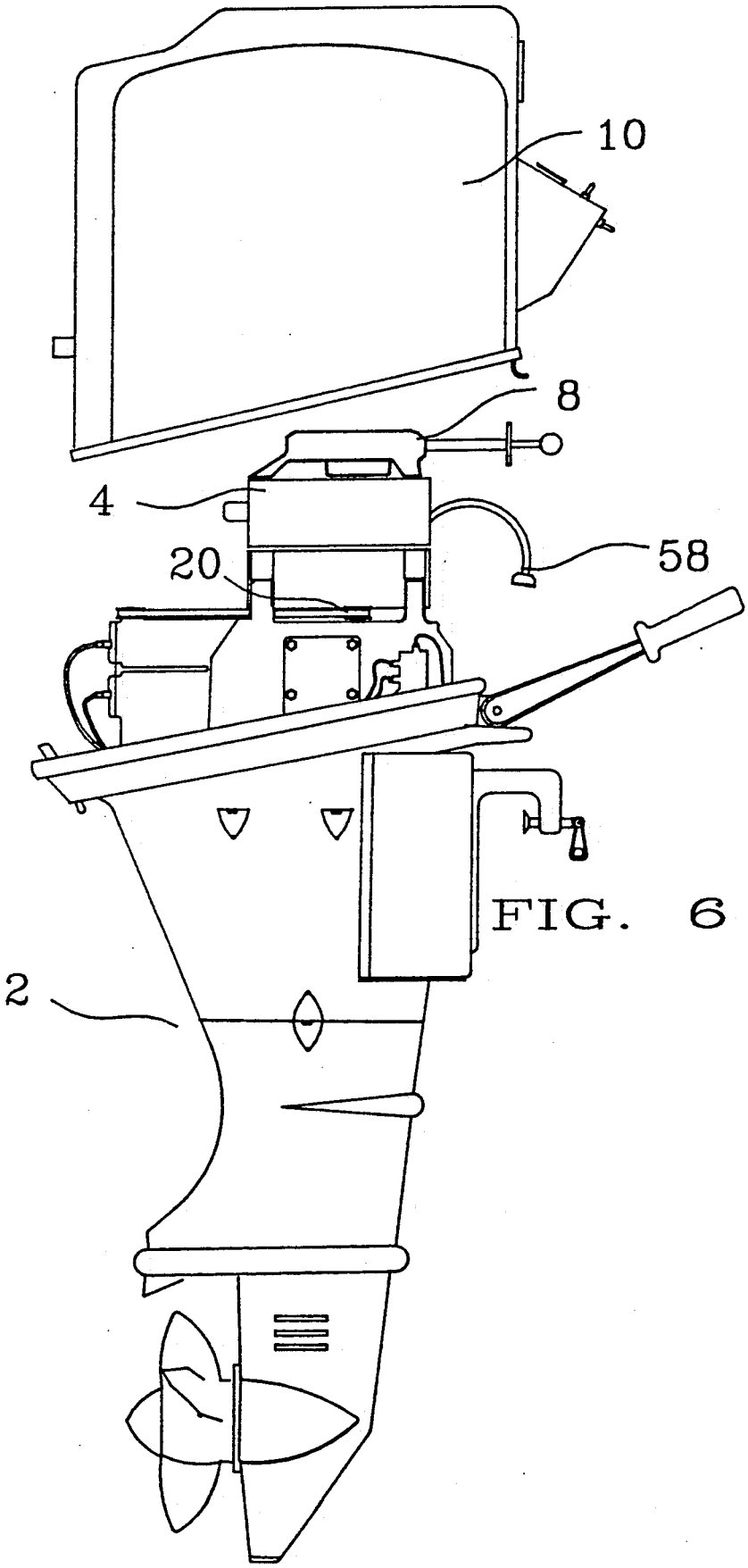
FIG. 6 is an exploded side view of an alternative embodiment.

The FIG. 2 embodiment is for retrofits. FIG. 6 shows an alternative embodiment, suitable for original equipment manufacturers, with the alternator 4 directly connected to the crankshaft 20, and the rotor acting as the flywheel.

It will be appreciated that the above description relates to the preferred embodiment by way of example only. Many variations on the invention will be obvious to those knowledgeable in the field, and such obvious variations are within the scope of the invention as described and claimed, whether or not expressly described.

What is claimed as the invention is:

1. For use in outboard motors having a flywheel with a recoil starter mounted coaxially with facing sides adjacent to each other, an auxiliary power generation device comprising:

an alternator adapted for installation between said flywheel and said recoil starter, said alternator having a rotor shaft projecting from both ends of the alternator, for mounting coaxially with said flywheel and said recoil starter;

means mounted on the facing side of said flywheel for engaging means mounted on the near end of the rotor shaft of said alternator, whereby rotation of said flywheel produces rotation of said alternator rotor shaft, and vice versa;

means connecting said recoil starter with the other end of said rotor shaft.

* * * * *